US005214898A

United States Patent [19]

Beretta

[11] Patent Number: 5,214,898

[45] Date of Patent: Jun. 1, 1993

[54] BLOCK PARTICULARLY FOR BUILDING LOOSE-LAID RETAINING WALLS

[75] Inventor: Mario Beretta, Sirtori, Italy

[73] Assignee: RDB Plastotecnica S.p.A., Vigano' Brianza, Italy

[21] Appl. No.: 740,245

[22] Filed: Aug. 5, 1991

[30] Foreign Application Priority Data

Aug. 20, 1990 [IT] Italy ..... 21289 A/90

[51] Int. Cl.[5] ..... E02D 27/00; E04C 2/04

[52] U.S. Cl. ..... 52/606; 52/689; 52/169.2; 47/82; 405/284

[58] Field of Search ..... 52/604–608, 52/589, 593, 192, 248, 169.2, 169.3, 169.4, 606, 169; 405/262, 284–287; 47/82, 83

[56] References Cited

U.S. PATENT DOCUMENTS

| | | | |
|---|---|---|---|
| 849,984 | 4/1907 | Dougherty | 52/192 |
| 894,122 | 7/1908 | Dougherty | 52/604 |
| 1,063,218 | 6/1913 | Rook | 52/595 |
| 1,264,689 | 4/1918 | Schlichter | 52/248 |
| 1,296,559 | 3/1919 | Rook | 52/604 |
| 1,383,166 | 6/1921 | Steinkraus | 52/248 |
| 4,329,089 | 5/1982 | Hilfiker et al. | 405/287 |
| 4,661,023 | 4/1987 | Hilfiker | 405/262 |
| 4,957,395 | 9/1990 | Nelson | 405/287 |
| 5,066,169 | 11/1991 | Gavin et al. | 405/262 |

FOREIGN PATENT DOCUMENTS

| | | |
|---|---|---|
| 267334 | 11/1986 | European Pat. Off. . |
| 232644 | 12/1986 | European Pat. Off. . |

*Primary Examiner*—James L. Ridgill, Jr.

*Attorney, Agent, or Firm*—Guido Modiano; Albert Josif

[57] ABSTRACT

The block has a cambered front radiused to tapering side walls. The side walls have, in the portion radiused to the front, mutually opposite insertion-coupling members and seats for accommodating the insertion-coupling members of an adjacent block. The block furthermore has, at an upper part thereof, an abutment for engagement with a supporting element defined on a lower part at the front of an adjacent block.

14 Claims, 2 Drawing Sheets

Fig.6
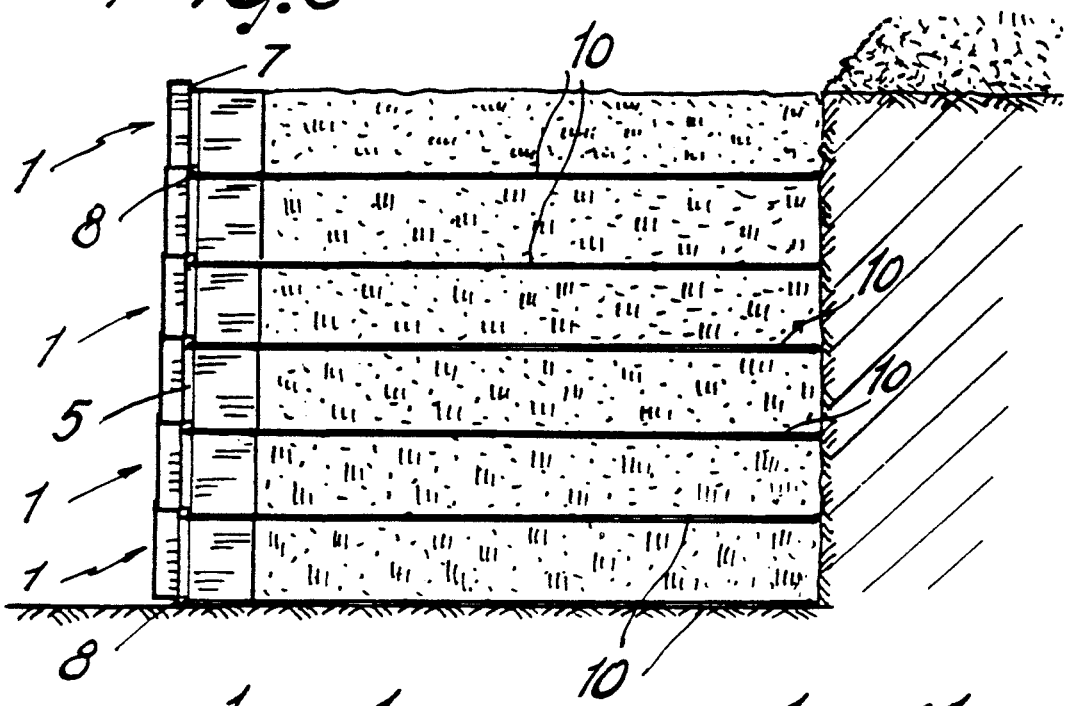
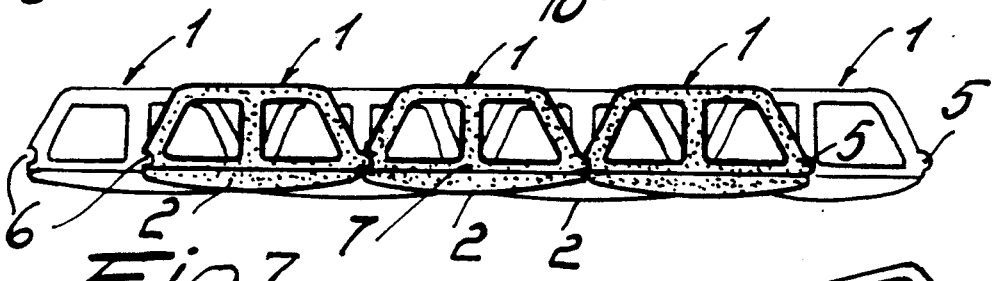
Fig.7
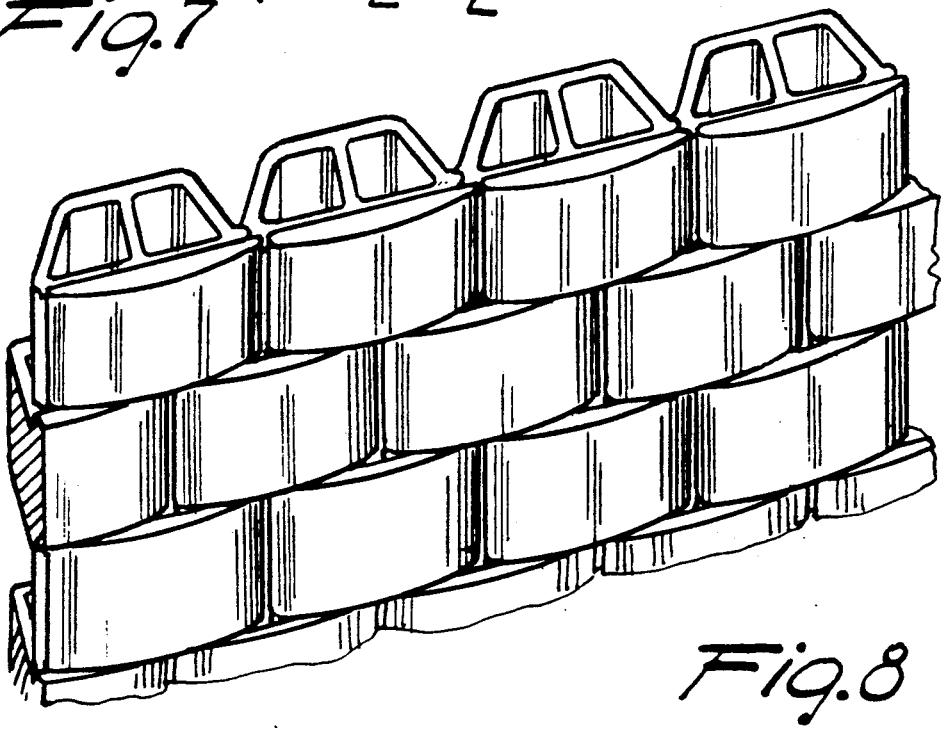
Fig.8

BLOCK PARTICULARLY FOR BUILDING LOOSE-LAID RETAINING WALLS

BACKGROUND OF THE INVENTION

The present invention relates to a block particularly for building retaining walls, and especially for building loose-laid retaining walls.

Special bricks or panels are used in the building of loose-laid or dry-laid walls for ground containment or for environmental decoration; said special bricks or panels have different front shapes and usually have a raised portion for engagement between successive stacked rows. Loose-laid containment or retaining walls built with these special bricks or panels usually have an awkward upward sloping orientation. Furthermore, a constant and conspicuous indentation pitch occurs between stacked rows of special bricks due to the thickness of the raised engagement portion.

Said special bricks are usually not provided with mutual lateral elements for retention among flanking special bricks. If they are, they are usually obtained by means of flanges added to the row of special bricks after laying, and this entails a further expenditure of labor during the building of the loose-laid retaining wall.

Said special bricks, despite having specifically executed angle elements, furthermore usually have mutually parallel side walls, thus entailing considerable problems during the building of curved containment walls.

SUMMARY OF THE INVENTION

The aim of the present invention is to eliminate or substantially reduce the problems described above in known types of special bricks by providing a block particularly for building loose-laid retaining walls which substantially reduces the upward sloping of the containment wall.

Within the scope of the above aim, an object of the present invention is to provide a block which eliminates the use of flanges for connection between mutually adjacent blocks.

Another object of the present invention is to provide a block which facilitates the building of curved retaining walls with curves having mutually complementary radii.

Not least object of the present invention is to provide a block particularly for building loose-laid retaining walls which is relatively easy to manufacture at competitive costs.

This aim, the objects mentioned and others which will become apparent hereinafter are achieved by a block, particularly for building retaining walls, according to the invention, which comprises a cambered front, characterized in that it comprises tapering side walls each of which has, in its portion connected to said front, selective insertion-coupling means and seats for accommodating insertion-coupling means of an adjacent block, said block being furthermore provided above with an abutment for supporting means defined in the lower part of said front.

BRIEF DESCRIPTION OF THE DRAWINGS

Further characteristics and advantages of the invention will become apparent from the description of a preferred but not exclusive embodiment of a block according to the invention, illustrated only by way of non-limitative example in the accompanying drawings, wherein:

FIG. 6 is an elevation view of an example of a retaining wall built with blocks according to the invention and ground retention nets or the like;

FIG. 7 is a plan view of layers of stacked blocks; and

FIG. 8 is a perspective view of a containment wall built with blocks according to the invention.

DESCRIPTION OF THE PREFERRED EMBODIMENTS

Figure 1:
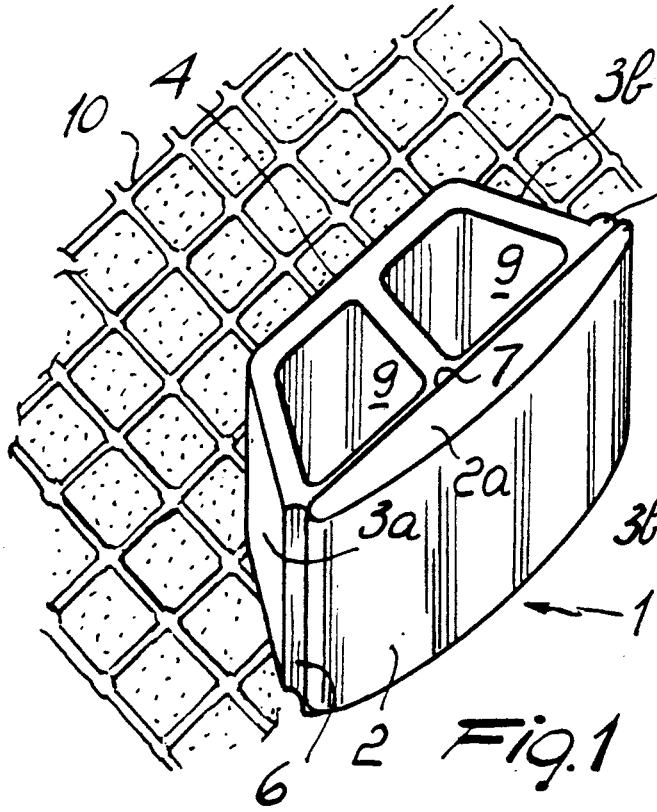
FIG. 1 is a perspective top view of a block according to the invention with a ground retention net.
Figure 2:
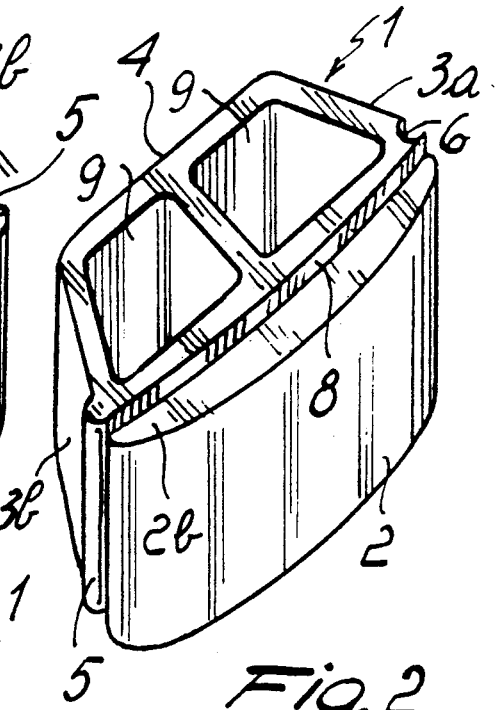
FIG. 2 is a perspective bottom view of a block according to the invention.

With reference to FIGS. 1 and 2, a block, generally indicated by the reference numeral 1, comprises a cambered front 2 having an upper edge 2*a* and a lower edge 2*b*. The front 2 is substantially radiused to tapering side walls 3*a* and 3*b* which are in turn radiused to a back wall 4. The block 1 substantially has the shape of an equilateral trapezoid.

The side walls 3*a* and 3*b* have, in their portion radiused to the front 2, insertion-coupling means, indicated by the reference numeral 5, which protrude from the radiused portion, and accommodation seats, indicated by the reference numeral 6, recessed within the radiused portion, for accommodating the insertion-coupling means 5 of an adjacent block. The block 1 furthermore has an abutment 7, which extends upwardly with respect to the block 1, for engagement with supporting means 8 defined in the lower part of the front 2 of an adjacent block.

Figure 3:
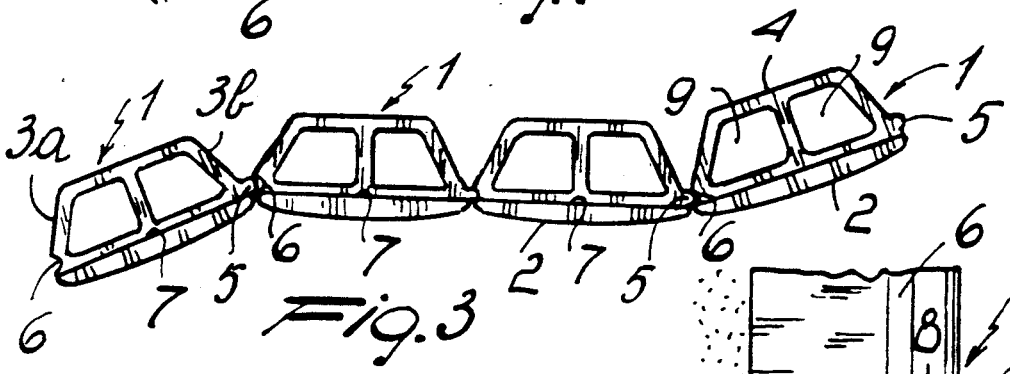
FIG. 3 is a plan view of a row of blocks arranged side by side and mutually interconnected.

The insertion-coupling means 5 and the accommodation seats 6 substantially have the shape of a circular sector, as illustrated in the above mentioned figures. The accommodation seat 6 has the configuration of a concave circular sector and the insertion coupling means 5 has the configuration of a convex circular sector. This shape allows to vary, as illustrated in FIG. 3, the angle of engagement between two mutually flanking blocks 1. In this manner it is possible to continuously vary the shape of the resulting wall, in particular in order to maintain, for example, the natural shape of escarpments which are thus protected and retained.

Figure 4:
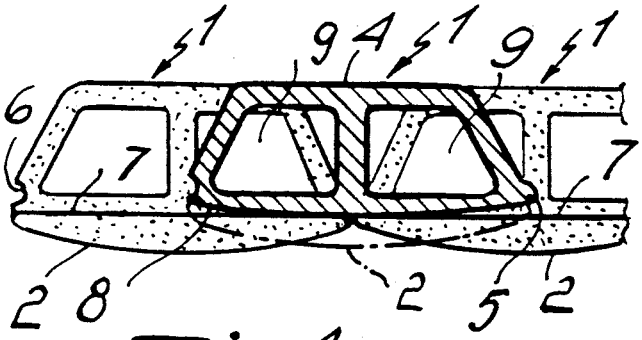
FIG. 4 is a partially sectional plan view of the stacking of layers of blocks.
Figure 5:
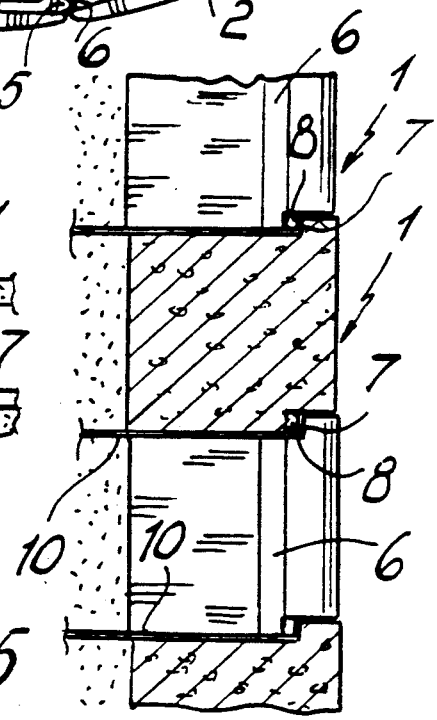
FIG. 5 is an elevation view of layers of stacked blocks.

The abutment 7 and the supporting means 8 have mutually different geometries; in particular, the abutment 7 is substantially rectilinear, i.e., shaped like a segment of a straight line, whereas the supporting means 8 have the shape of an arc of a circumference. The abutment 7 is substantially tangential to the arc-shaped supporting means. The coupling of these different configurations, as more clearly illustrated in FIG. 4, allows to also build containment walls with a very slight volute-like shape; the coupling between a straight segment and an arc of circumference in fact allows a very large number of points of contact, as is well known in geometry.

The block 1 furthermore comprises weight-reducing holes 9 which are defined within the body of said block and can accommodate filling material or supports of the loose-laid or dry-laid retaining walls. The supporting planes between a block 1 and the upper or lower block are planar, with upper abutments 7 and lower supporting means 8.

A retaining wall, as illustrated in FIGS. 5 to 8, comprises a plurality of blocks 1, as previously described, arranged mutually side by side in rows and stacked. Ground reinforcement means, usually constituted by ground retention nets 10 or the like, such as for example strips of appropriate fabric, or engagement brackets, can be inserted between one layer of blocks 1 and the other with no coupling to said blocks.

As illustrated in FIG. 6, the ground retention nets 10 are interposed between the layers of blocks 1 and extend into the ground. The building of a loose-laid or dry-laid containment wall with the blocks 1 according to the invention comprises the execution of the foundations, i.e. the base perimeter of the escarpment to be contained is initially removed in order to obtain a supporting plane for the ground retention nets 10 and/or a channel for accommodating the base layer of blocks 1 or a channel in which a bed for the base layer of blocks 1 is cast. Once the ground retention net 10 is deposited on the stripped ground and on the layer of blocks 1, with the ground retention net engaged between the layer of blocks and the foundations or between the layer of blocks and the supporting ground, a layer of soil is spread on said ground retention net and is compacted with a light compaction machine in the vicinity of the wall and with a heavy compaction machine elsewhere. The immediately overlying layer, and the other layers until the retaining wall is completed, are executed in the same manner, except that the ground retention net is deposited on the previously laid soil, after compaction, and on the layer of blocks, whereas the subsequent layer of blocks is placed on the preceding layer of blocks, locking the ground retention nets between the layers of blocks.

The weight-reducing holes 9 can either be filled with soil or act as seats for supports or guides, such as poles and the like, for building said containment wall.

It has been observed that a block according to the invention achieves the proposed aim and objects, and furthermore constitutes a valid system, in association with ground retention nets or the like, for ground containment with loose-laid walls. The block furthermore effectively contributes to the building of non-rectilinear retaining walls or more precisely of walls comprising circular sectors with complementary radii, such as for example S-shaped walls.

The invention thus conceived is susceptible to numerous modifications and variations, all of which are within the scope of the inventive concept. For example, the abutment 7 and the supporting means 8 can have an identical straight geometry to provide straight containment walls more easily. The ground retention nets or the like can furthermore be engaged with the block by means of hooks, rods or the like fixed to the blocks according to the invention.

All the details may furthermore be replaced with other technically equivalent elements.

In practice, the materials employed, as well as the dimensions, may be any according to the requirements.

I claim:

1. Block for building loose-laid retaining walls comprising;

a back wall;

two tapering side walls radiused to said back wall;

a radiused portion defined by each of said tapering side walls;

a cambered front radiused to said tapering side walls and having an upper edge and a lower edge;

an accommodation seat recessed within said radiused portion of one of said tapering side walls, insertion coupling means protruding from said radiused portion of another one of said tapering side walls and being accommodatable in an accommodation seat of an adjacent block;

a substantially rectilinear abutment extending upwardly from said block adjacent said upper edge of said cambered front and extending parallel to said back wall from said accommodation seat to said insertion coupling means, and;

arc-shaped supporting means defined in said block adjacent said lower edge of said cambered front and extending from said accommodation seat to said insertion coupling means, said arc-shaped supporting means being engageable in abutment engagement relationship with a substantially rectilinear abutment of an adjacent block.

2. Block according to claim 1, wherein said substantially rectilinear abutment extends from said radiused portion of one of said tapering side walls adjacent said insertion coupling means to said radiused portion of said other of said tapering side walls adjacent said accommodation seat.

3. Block according to claim 1, wherein said cambered front, said substantially rectilinear abutment and said arc-shaped supporting means are longer than said back wall.

4. Block according to claim 1, wherein said accommodation seat and said insertion coupling means extend substantially perpendicular to said substantially rectilinear abutment and said arc-shaped supporting means.

5. Block according to claim 1, wherein said back wall, said two tapering side walls and said cambered front define a substantially equilateral trapezoid.

6. Block according to claim 1, wherein said accommodation seat and said insertion coupling means each have the shape of a circular sector.

7. Block according to claim 1, wherein said substantially rectilinear abutment is substantially tangential to said arc-shaped supporting means.

8. Block for building loose-laid retaining walls comprising;

a back wall;

two tapering side walls radiused to said back wall;

a radiused portion defined by each of said tapering side walls;

a cambered front radiused to said tapering side walls and having an upper edge and a lower edge;

an accommodation seat recessed within said radiused portion of one of said tapering side walls, insertion coupling means protruding from said radiused portion of another one of said tapering side walls and being accommodatable in an accommodation seat of an adjacent block;

a substantially rectilinear abutment extending upwardly from said block adjacent said upper edge of said cambered front and extending parallel to said back wall from said accommodation seat to said insertion coupling means, and;

arc-shaped supporting means defined in said block adjacent said lower edge of said cambered front and extending from said accommodation seat to said insertion coupling means, wherein said arc-shaped supporting means are engageable in abutment engagement relationship with a substantially rectilinear abutment of an adjacent block, and wherein said substantially rectilinear abutment is substantially tangent to said arc-shaped supporting means.

9. Block according to claim 8, wherein said substantially rectilinear abutment extends between said radiused portion of one of said tapering side walls to said radiused portion of said other of said tapering side walls.

10. Block according to claim 8, wherein said cambered front, said substantially rectilinear abutment and said arc-shaped supporting means are longer than said back wall, and wherein said tapered side walls converge towards each other in a direction extending from said cambered front to said back wall.

11. Block according to claim 8, wherein said accommodation seat and said insertion coupling means extend across said cambered front in a direction perpendicular to said substantially rectilinear abutment and said arc-shaped supporting means.

12. Block according to claim 8, wherein said back wall, said two tapering side walls and said cambered front together define a substantially equilateral trapezoid.

13. Block according to claim 8, wherein said accommodation seat has the shape of a concave circular sector, and wherein said insertion coupling means has the shape of a convex circular sector.

14. Block for building loose-laid retaining walls comprising;

a back wall;

two tapering side walls radiused to said back wall;

a radiused portion defined by each of said tapering side walls;

a cambered front radiused to said tapering side walls and having an upper edge and a lower edge;

a substantially equilateral trapezoid configuration defined by said back wall, said tapering side walls and said cambered front;

an accommodation seat recessed within said radiused portion of one of said tapering side walls and having the shape of a concave circular sector;

insertion coupling means protruding from said radiused portion of another one of said tapering side walls and being accommodatable in an accommodation seat of an adjacent block, said insertion coupling means having the shape of a convex circular sector;

a substantially rectilinear abutment protruding upwardly from said block adjacent said upper edge of said cambered front and extending parallel to said back wall from said radiused portion of one of said tapering side walls adjacent said insertion coupling means to said radiused portion of said other of said tapering side walls adjacent said accommodation seat and;

arc-shaped supporting means defined in said block adjacent said lower edge of said cambered front and extending from said accommodation seat to said insertion coupling means, wherein said cambered front, said substantially rectilinear abutment and said arc-shaped supporting means are longer than said back wall, said tapered side walls converging towards each other in a direction extending from said cambered front to said back wall, said accommodation seat and said insertion coupling means extending across said cambered front in a direction perpendicular to said substantially rectilinear abutment and said arc-shaped supporting means, and wherein said arc-shaped supporting means being engageable in abutment engagement relationship with a substantially rectilinear abutment of an adjacent block, said substantially rectilinear abutment being substantially tangent to said arc-shaped supporting means.

* * * * *